313-422
3/8/83 SR
OR 4,376,258

United States Patent [19]
Glock

[11] 4,376,258
[45] Mar. 8, 1983

[54] SHIELDED BEAM GUIDE STRUCTURE FOR A FLAT PANEL DISPLAY DEVICE AND METHOD OF MAKING SAME

[75] Inventor: Thomas L. Glock, Allentown, N.J.

[73] Assignee: RCA Corporation, New York, N.Y.

[21] Appl. No.: 254,648

[22] Filed: Apr. 16, 1981

[51] Int. Cl.[3] ..... H01J 29/06; H01J 9/14
[52] U.S. Cl. ..... 313/422; 445/36; 445/49
[58] Field of Search ..... 313/422, 403, 402; 29/25.14, 25.18

[56] References Cited

U.S. PATENT DOCUMENTS 4,031,427 6/1977 Stanley ..... 313/422
4,101,802 7/1978 Andrevski ..... 313/422
4,308,484 12/1981 Carroll et al. ..... 313/422 X

*Primary Examiner*—Palmer C. Demeo
*Attorney, Agent, or Firm*—Eugene M. Whitacre; Dennis H. Irlbeck; Lester L. Hallacher

[57] ABSTRACT

An electron beam guide assembly for a flat panel display device includes two guide meshes. One mesh is substantially flat and the other is shaped. The shaped mesh has a substantially flat surface and includes longitudinal sides which extend angularly away from the flat surface. The sides are further shaped to include flanges which lie in a plane substantially parallel to and displaced from the flat surface. The flanges are joined to the flat mesh to form an assembly having continuously shielded longitudinal sides.

9 Claims, 3 Drawing Figures

SHIELDED BEAM GUIDE STRUCTURE FOR A FLAT PANEL DISPLAY DEVICE AND METHOD OF MAKING SAME

BACKGROUND OF THE INVENTION

This invention relates generally to flat panel display devices and particularly to a beam guide structure having continuously shielded longitudinal sides for use in such devices.

U.S. Pat. No. 4,101,802 discloses a flat panel display device including two beam guide meshes held in a spaced parallel relationship by metal spacers. The spacers extend the entire length along both sides of the beam guide meshes. The beam guide meshes include a plurality of apertures which are arranged in columns longitudinally along the meshes and in rows transversely across the meshes. The columns of apertures in the two meshes are transversely aligned so that the columns of apertures serve as beam guides for electron beams which propagate in the space between the two meshes.

This structure is operationally satisfactory for purposes intended. However, problems arise because the transverse alignment and relative longitudinal positioning of the apertures in the two guide meshes must be very accurately maintained in order for the electron beams to effectively propagate the full length of the channels. The apertures must be dimensioned and aligned to tolerances in the order of 1 mil. Additionally, the longitudinal alignment of the spacers along the sides of the meshes must be held to equally close tolerances. For those reasons, initial alignment of the many parts and the subsequent maintaining of such alignment during joining of these parts is a very difficult and costly task with the technology presently available.

U.S. patent application Ser. No. 125,822, filed Feb. 29, 1980 by Marvin Allan Leedom, now U.S. Pat. No. 4,330,735, entitled "Beam Guide Structure For Flat Panel Display Device" and assigned to RCA Corporation, the assignee of the instant application, also discloses a flat panel display device in which electron beams are propagated between spaced parallel beam guide meshes. In this device, the spaced parallel relationship of the beam guide meshes, and the focus and acceleration meshes which are spaced therefrom, are held in the desired positions and orientations by a plurality of insulative members in which the edges of the meshes ae embedded. This structure is also satisfactory for the purposes intended and eases the difficulty of holding the meshes in the desired positions and orientations during joining. However, problems nevertheless arise because the longitudinal sides of the electron beam propagation spaces between the beam guide meshes are open thereby permitting the insulative members to be charged by electrons and distort the electron beams.

The instant invention overcomes these difficulties by the provision of an electron beam guide structure which is simple to accurately fabricate and assemble and which provides continuously shielded longitudinal sides to isolate the propagating electron beams from the effects of influences outside of the guide meshes.

SUMMARY OF THE INVENTION

A beam guide assembly for a flat panel display device includes a substantially flat guide mesh. A shaped guide mesh includes a substantially planar surface and is shaped to include sides extending angularly away from the planar surface. The sides are shaped to form flanges which lie in a plane substantially parallel to and displaced from the planar surface. The flanges are joined to the flat guide mesh to form a beam guide assembly having continuously shielded longitudinal sides.

DETAILED DESCRIPTION OF THE PREFERRED EMBODIMENT

Figure 1:
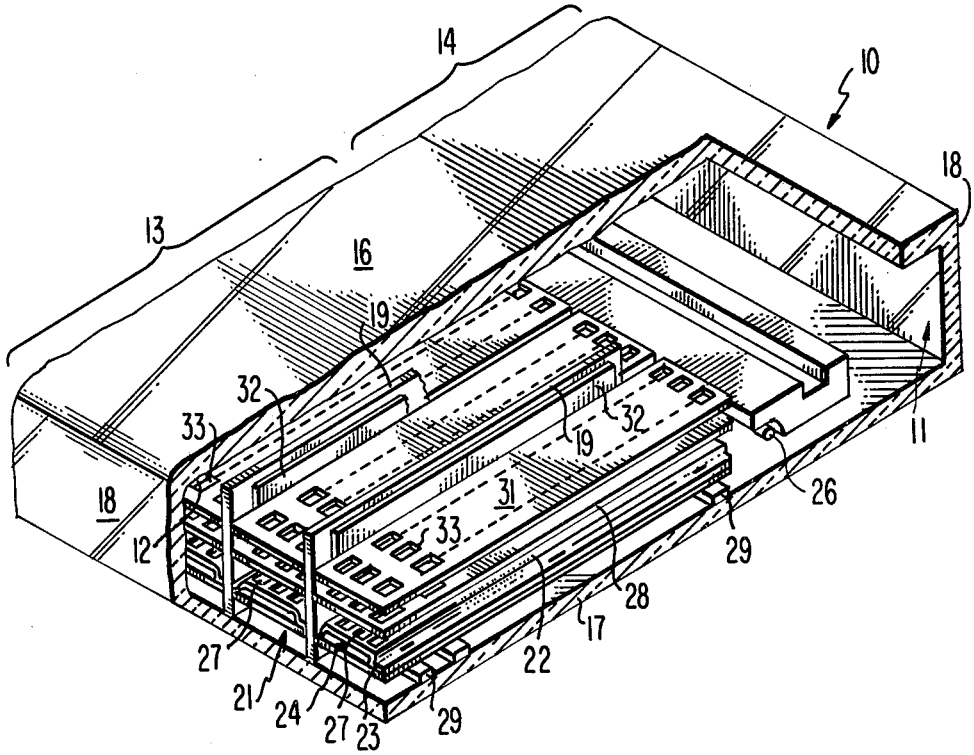
FIG. 1 is a perspective view, partially broken away, of a flat panel display device incorporating the preferred embodiment.

FIG. 1 shows a flat panel display device 10 which incorporates the preferred embodiment. The display device 10 includes an evacuated envelope 11 having a display section 13 and an electron gun section 14. The envelope 11 includes a frontwall 16 and a baseplate 17 held in a spaced parallel relationship by sidewalls 18. A display screen 12 is positioned on the frontwall 16 and gives a visual output when excited by electrons.

A plurality of spaced parallel support vanes 19 are arranged between the frontwall 16 and the baseplate 17. The support vanes 19 provide the desired internal support against external atmospheric pressure and divide the envelope 11 into a plurality of channels 21. Each of the channels 21 encloses a pair of spaced parallel beam guide meshes 22 and 23 extending transversely across the channels and longitudinally along the channels from the gun section 14 to the opposite sidewall 18. A cathode 26 is arranged to emit electrons into the spaces 24 between the guide mesh pairs. The guide meshes 22 and 23 include apertures 27 which are arranged in columns longitudinally along the channels 21 and in rows transversely across the channels. A focus mesh 28 is spaced above the upper guide mesh 22 in a parallel relationship therewith. A plurality of extraction electrodes 29 are arranged along the baseplate 17 to extend transversely across the channels 21 the full width of the display device 10. The extraction electrodes 29 are arranged directly beneath the rows of apertures 27 in the guide meshes 22 and 23. Appropriate voltages are applied to the focus mesh 28 and the extraction electrodes 29 to cause the electrons emitted from the cathode 26 to propagate between the guide meshes 22 and 23 in the spaces 24 for the full length of the channels.

An acceleration mesh 31 is arranged in a spaced parallel relation with the focus meshes 28 and contains a plurality of apertures 33 which also are aligned in columns longitudinally of the channels and in rows transversely of the channels. Scanning electrodes 32 are arranged on both sides of the support vanes 19 so that each vane supports a scanning electrode for two adjacent channels.

In operation, the electron beams propagate in the spaces 24 between the guide meshes 22 and 23 until the production of one line of the visual display requires the beams to be directed toward the screen 12. Extraction of the electron beams from the spaces between the guide meshes is effected by applying a negative voltage to one of the extraction electrodes 29. The negative voltage causes the electron beams to pass through the apertures 27 in the guide meshes and the apertures 33 in the acceleration mesh 31 and the focus mesh 28. The extracted electron beams are transversely scanned across the channels 21 by the application of varying voltages, such as sawtooth waveforms, to the scanning electrodes 32 on the sides of the support vanes 19. Every channel therefore is transversely scanned between the two support vanes 19 so that each channel contributes a portion of each line of the visual display on the faceplate 16.

Figure 2:
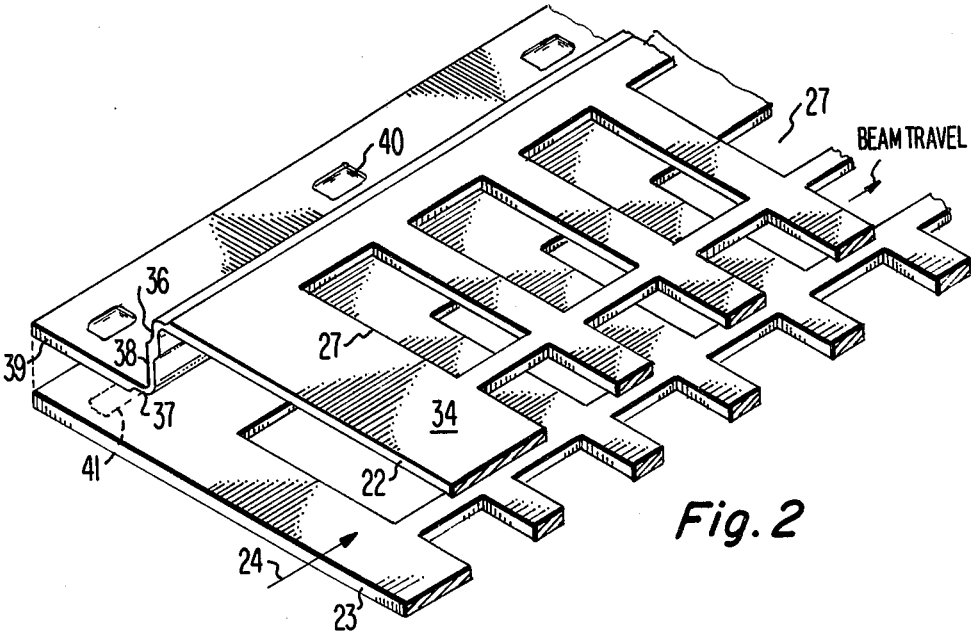
FIG. 2 is a perspective view, partially broken away, of one side of the preferred embodiment showing the guide meshes unassembled.

In FIG. 2 portions of one side of the guide meshes 22 and 23 are shown unassembled. The guide mesh 22 is formed into a shaped guide mesh including a planar surface 34. The mesh 22 includes two longitudinal lines of reduced thickness 36 and 37, both of which extend substantially parallel to the columns of apertures 27 along the entire length of the mesh. The lines 36 and 37 can be formed by etching, scribing or any other fabrication technique which reduces the thickness of the metal from which the mesh is made. These lines serve as bend lines and eliminate stress and deformation which would occur without them. The mesh 22 is bent along the line 36 to form a side 38 extending angularly away from the planar surface 34. Preferably the angle is in the order of 90°. The side 38 extends the entire length of the mesh 22. The side 38 is bent along the line 37 to form a flange 39 along the length of the mesh 22. The flange 39 lies in a plane which is substantially parallel to and spaced from the planar surface 34. Spaced along the flange 39 are areas of reduced thickness 40 where approximately one half of the thickness of the flange material is removed by etching or other convenient fabrication process.

The mesh 23 is a flat guide mesh and also includes areas of reduced thickness 41 which are longitudinally spaced at intervals identical to the spacing of the reduced thickness areas 40 in the flange 39. The areas of reduced thickness 40 and 41 are placed into the surfaces which do not face one another. Accordingly, the mating surfaces of the flange 39 and the mesh 23 are smooth and uniform to assure equal spacing of the meshes.

Figure 3:
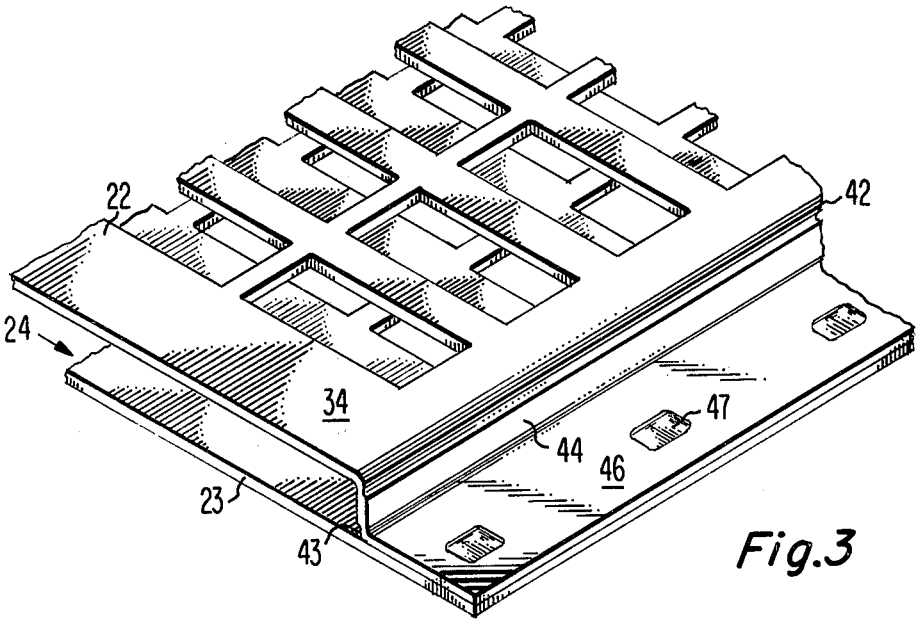
FIG. 3 is a perspective view, partially broken away, of the other side of the preferred embodiment showing the guide meshes assembled.

FIG. 3 shows portions of the other side of the meshes 22 and 23 joined together. The mesh 22 includes a two additional longitudinal lines of reduced thickness 42 and 43 along which the mesh is bent to form a second side 44 and a second flange 46. The sides 38 and 44 are equally dimensioned so that the space 24 between the mesh 23 and the planar surface 34 of the mesh 22 is longitudinally and transversely uniform along the entire length of the beam guide assembly. The lines 36 and 42 are equally spaced from the longitudinal center line of the flat surface 34 and therefore the electrical effects of the sides 38 and 44 in the space 24 are the same. The flange 46 includes longitudinally spaced areas of reduced thickness 47. Corresponding spaced areas of reduced thickness (not shown) are provided in the mesh 23 to facilitate the permanent joining of the flange 46 and the mesh 23. The reduced thickness of those areas is effective as a means for reducing stresses when the meshes are joined by welding, or other method.

The sides 38 and 44 form continuously extending longitudinal shields for the sides of the space 24 so that electron beams propagating along the columns of apertures are unaffected by undesirable influences caused by other elements of the display device. Additionally, because the flanges 39 and 46 extend outwardly beyond the sides 38 and 44, the techniques for assembling the beam guides to the focus and guide meshes disclosed in U.S. Application Ser. No. 125,822 and U.S. Pat. No. 4,101,802 can be used to assembly complete mesh assemblies while eliminating the operational and assembly problems associated with the referenced structures. Additionally, the inventive beam guide assembly is advantageous because the longitudinal lines 36, 37, 42 and 43, the apertures 27 and the areas of reduced thickness 40, 41 and 47 can be simultaneously, accurately and inexpensively formed by etching. Additionally, because etching techniques are quite accurate, the areas of reduced thickness where the flanges and meshes are joined can be very accurately located on the respective meshes. Accordingly, during assembly accurate alignment of these areas automatically transversely aligns and longitudinally positions the apertures 27 in the manner desired. The flanges 39 and 46 also provide a convenient means of holding meshes while being joined. Also, the flat guide meshes 23 and the shaped guide 22, after shaping, can be longitudinally and transversely equally dimensioned as an aid in aligning and positioning the apertures 27 during the permanent joining of the two meshes 22 and 23.

What is claimed is:

1. An electron beam guide assembly for a flat panel display device comprising:

a substantially flat guide mesh including a plurality of apertures arranged in columns longitudinally along said mesh and transversely across said mesh; and a shaped guide mesh having a substantially planar surface and including a plurality of apertures arranged in columns longitudinally along said planar surface and in rows transversely across said planar surface, said shaped guide mesh being longitudinally bent to include sides extending angularly away from said planar surface, said sides being bent to include flanges extending from said sides in a plane substantially parallel to and displaced from said planar surface said shaped guide mesh being attached to said flat guide mesh along said flanges to form a beam guide assembly having continuously shielded longitudinal sides.

2. The beam guide assembly of claim 1 wherein said meshes are attached by a plurality of areas of reduced thickness correspondingly spaced along said flanges and said flat guide mesh, said areas in said flanges and said areas in said flat mesh being aligned to permit stress free joining of said meshes.

3. The beam guide assembly of claim 2 wherein said shaped guide mesh includes a plurality of longitudinal lines of reduced thickness and wherein said sides and said flanges are bent along said lines.

4. The beam guide assembly of claim 3 wherein said guide meshes are substantially equally dimensioned longitudinally and transversely and wherein said columns of apertures in said guide meshes are transversely aligned.

5. The beam guide assembly of claim 4 wherein said sides are substantially perpendicular to said flat surface.

6. A method of making a beam guide assembly having shielded longitudinal sides comprising the steps of:

forming a substantially flat guide mesh having longitudinal columns of apertures in said mesh;

forming a shaped guide mesh having a substantially planar surface including longitudinal columns of apertures in said planar surface, bending said mesh to form longitudinal sides extending angularly away from said planar surface with said columns of apertures between said sides, bending said sides to form longitudinal flanges lying in a plane substantially parallel to said planar surface; and joining said flanges to said flat guide mesh.

7. The method of claim 6 further including the step of reducing the thickness of said planar surface along longitudinal lines and making said bends along said lines.

8. The method of claim 7 further including the step of reducing the thickness in areas of said flanges and in areas of said flat guide mesh and joining said flanges and said flat guide mesh at said areas of reduced thickness.

9. The method of claim 8 wherein said joining is accomplished by welding.

* * * * *